United States Patent [19]

Stanley

[11] Patent Number: 5,042,799

[45] Date of Patent: Aug. 27, 1991

[54] PORTABLE ARM AND LEG EXERCISE DEVICE UTILIZING A FRICTION FORCE RESISTER

[76] Inventor: Ronald F. Stanley, 689 Beechwood, Lake Zurich, Ill. 60047

[21] Appl. No.: 597,998

[22] Filed: Oct. 9, 1990

[51] Int. Cl.[5] ..... A63B 21/02

[52] U.S. Cl. ..... 272/138; 272/116; 272/130; 272/131; 272/134; 272/139; 272/143

[58] Field of Search ..... 272/67, 116, 130, 131, 272/132, 134, 136, 137, 138, 139, 142, 143

[56] References Cited

U.S. PATENT DOCUMENTS

| | | | |
|---|---|---|---|
| 3,604,307 | 9/1971 | Vono | 272/67 |
| 3,976,057 | 8/1976 | Barclay | 272/130 |
| 4,157,179 | 6/1979 | Ecklor, Jr. | 272/67 |
| 4,327,909 | 5/1982 | Neufeld | 272/137 |
| 4,589,655 | 5/1986 | Ammon | 272/67 |
| 4,836,531 | 6/1989 | Niks | 272/67 |
| 4,899,735 | 2/1990 | Townsend et al. | 272/67 |

*Primary Examiner*—Richard J. Apley
*Assistant Examiner*—Lynne A. Reichard
*Attorney, Agent, or Firm*—Alan B. Samlan

[57] ABSTRACT

A portable exercise device for exercising and strengthening a user's arm and leg muscles which utilizes a spring mechanism connected to an adjustable lever arm which the user must pivot in the exercise routine. The adjustable lever arm is connected at a pivot point to a support bar which is designed to rest against the back of the user's triceps. A shoulder harness extends from the top of the elongated support bar and supports the device on the user's shoulder. There is a hand grip at the end of the shoulder harness to be grasped by the user's hand on the non-exercising arm. At the end of the adjustable lever arm opposite the pivot connection is a hand grip which is grasped by the user and pulled on in the exercise routine. The spring applies the counter force to the adjustable lever arm and is the force which the user must overcome during exercising the muscles. With a leg strap the device can be strapped to the top of the user's leg between the hip and knee. The hand grip can then receive the bottom on the user's leg and the user can do leg curls to exercise the leg muscles. By means of attaching a rigid bar to the adjustable lever arm and with the device strapped to the user's leg, the exercise device can be also used to exercise the triceps. Accordingly, three different exercises can be performed with a single device.

18 Claims, 3 Drawing Sheets

PORTABLE ARM AND LEG EXERCISE DEVICE UTILIZING A FRICTION FORCE RESISTER

BACKGROUND OF THE INVENTION

This invention relates to exercise devices, and more particularly to a portable exercise device which provides variable resistance for progressive exercise and building of the arm and leg muscles.

Fitness and body building are growing interests in the United States. Fitness has been found to enhance overall health, as well as improving energy levels and stamina for enjoyment of recreational activities. Fitness improves the overall appearance of a person's body and as a result enhances one's self image. This enhancement attracts many people to increase training to build the body or work on specific trouble spots.

Various body building techniques are used to exercise specific muscles. There are exercise machines in gyms and health clubs which achieve the desired results. However, such machines are large, bulky and are very expensive, so that only wealthy people can afford them for home use. Free weights can be lifted to build the forearms, upper arms, shoulders and chest or back. The problem with free weights is that they are bulky to store and require additions of the weight disks to keep up with the progress of muscle building Another problem with prior art devices is that they require a fixed place of installation and a fairly large amount of room in which to be used. This is acceptable for the health club environment, but not for an individual's private use at home.

There has been designed and built numerous portable devices for exercising. For example, in U.S. Pat. No. 911,925 entitled Wrist Developer and Strength Tester, there is disclosed a portable device which utilizes an oscillating handle operating against a spring in order to develop ones wrists. However, the device is not designed for bicep development or for leg development. In U.S. Pat. No. 4,039,183 entitled Wrist Exercise and Strengthening Device, there is also illustrated a portable device which is adaptable for use by either arm. Again, however, this device is not adaptable for both arm and leg exercising. A third exercise device for exercising the forearm is illustrated in U.S. Pat. No. 4,861,022 entitled Portable Forearm Exerciser. This device consist of a pair of levers which are connected at a pivot point and in which the user pushes extending arms together against a resilient biasing band in order to exercise the forearms. This device is not adaptable for exercising biceps or leg muscles.

None of the devices found in the prior art are adaptable for exercising the biceps, triceps and leg muscles. One explanation is that these muscles generally require different movement and apparatus in order for individual groups of muscles to be exercised. At health clubs which have the advantage of large expensive equipment, the equipment may be able to be modified to accommodate several different groups of muscles. However, in the portable device arena, such has never been accomplished.

SUMMARY OF THE INVENTION

In the preferred embodiment there is disclosed a portable exercise device which is adaptable for exercising and strengthening a users biceps, triceps and the biceps femoris leg muscles. There is a fixed support bar having a cup or concave portion which receives the back of the user's arm during bicep exercises. The cup receives the user's leg during triceps and leg muscle exercises. There is a shoulder harness pivotally connected to the top end of the fixed support bar which extends over the user's shoulder during bicep exercises. At the end of the shoulder harness is a handle which is grasped by the non-exercising hand in order to stabilize the device. An adjustable lever arm has one end pivotally connected to the bottom end of the support bar. At the other end of the adjustable lever arm is a hand grip which is grasped by the hand of arm being exercised. A spring is connected to the top end of the elongated support bar and has a flexible connecting strap linking the end of the spring to the adjustable lever arm. By pulling on the hand grip and causing the adjustable lever arm to rotate around the pivotal connection against the force of the spring, the biceps are exercised.

In order to exercise the biceps femoris of the leg muscles the elongated fixed support is strapped to the user's leg and the cup envelopes the top portion of the leg between the hip and the knee. The hand grip has an opening which will receive the lower portion of the user's leg above the foot. Thus when doing leg exercises, the leg is pivoted downward, such that the adjustable lever arm rotates against the spring force.

The adjustment arm further has means to receive a rigid bar in a locked relationship and protruding upward from the adjustable lever arm when the user is in a seated position. The fixed support bar is strapped to the user's leg and the user pushes against the rigid bar with his forearm or hand to exercise the triceps.

OBJECTS AND ADVANTAGES

An object of the exercise device is to provide a device which is used to strengthen the biceps yet is easily transportable. Related to this object is the object of providing a portable exercise device which is adaptable for exercising not only the biceps but the triceps and bicep femoris on the legs.

Another object is the object of providing a portable exercise device which is adaptable for exercising several different groups of muscles without the need of additional individual mechanisms. Related to this object is the object of providing an exercise device which has greater versatility by exercising additional groups of muscles with either the addition of an adapter bar or a relocation of the device from the arm to the leg.

Yet another object is the object of providing a portable exercise device which provides a constant resistance force approximating the muscle's power curve maximizing the exercise routine.

Yet another object is the object of providing a portable exercise device having one or more springs applying a force against which the user must move a lever arm in order to exercise the muscle, the springs being replaceable with other springs to provide a varying amount of force against which the user exercises. The advantage is that with a singular device the user can continue to increase his strength by merely changing springs and resultant spring force.

Yet another object is the object of providing an exercise device which can exercise the biceps in one configuration and by strapping the device to the user's leg, is adapted to exercise the leg muscles and triceps.

These and other objects and advantages of this invention will become apparent to those skilled in the art when the following brief description of the drawings and detailed description of the preferred embodiment are studied.

DETAILED DESCRIPTION OF THE PREFERRED EMBODIMENT

Figure 1:
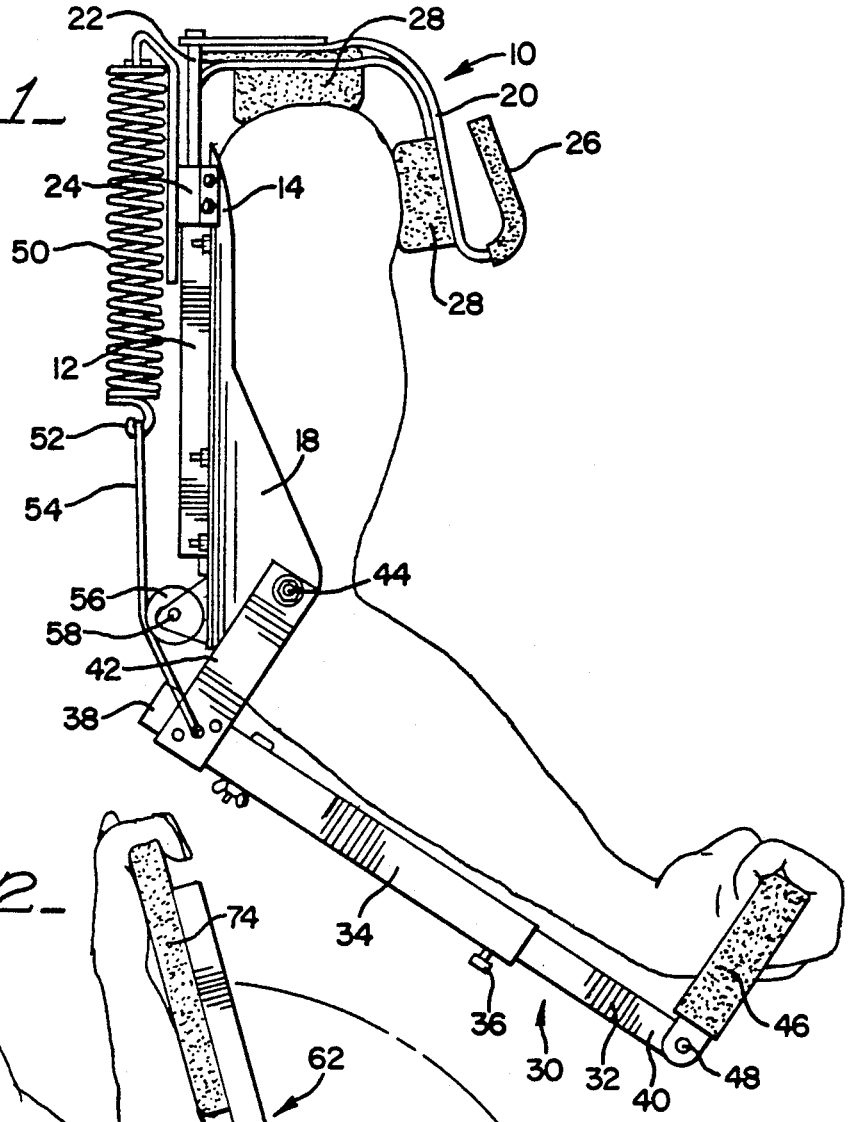
FIG. 1 is side view of the portable exercise device as fitted over the user's shoulder to exercise the biceps, illustrating the device part way through the exercise cycle.

Turning first to FIG. 1 there is illustrated a portable exercise device 10 having an elongated fixed support bar 12 with an upper end 14 and lower end 16. The fixed support bar 12 is adapted to be received against the rear portion of the user's arm, or tricep area as seen in FIG. 1. The user's arm is received by a concave cup like member 18 which wraps around the portion of the arm just above the elbow.

At the upper end 14 is mounted a shoulder harness 20 which is connected to an adjustable length rod 22 which joins to the upper end 14 by means of a pivotal connection 24. The end of the shoulder harness 20 opposite the pivotal connection 24 terminates in a handle 26. There are pads 28 which are connected to the underside of the shoulder harness 20 and rest against user's shoulder to provide a comfortable support on which the shoulder harness 20 can rest. In an alternate arrangement, the shoulder harness 20 can be designed with a padding structure built into it such that the pads 28 are not required. The adjustable length rod 22 can be slid vertically within the pivotal connection 24 to adjust the shoulder harness 20 with respect to the elongated fixed support bar 12. Accordingly, the overall length of the combination of the fixed support bar and adjustable length rod 22 can be adjusted to accommodate users of varying sizes. Once the desired length is set, a fastening screw passing through the pivotal connection 24 can be tightened on the adjustable length rod 22 to secure it in its proper length and position.

Located along the user's forearm is an adjustable lever arm 30 which has an adjustable shaft 32 received within a tubular housing 34. The overall length of the adjustable lever arm 30 can thus be adjusted by loosening or tightening a threaded thumb screw 36 which releases or locks the adjustable shaft 32 within the tubular housing 34. The adjustable lever arm 30 has an elbow end 38 and a wrist end 40. The elbow end 38 is connected to the lower end 16 of the fixed support bar 12 by means of a connecting link 42. The connecting linking is connected to the lower end 16 adjacent to the concave cup like member 18 by means of a pivot connection 44 which permits the connecting link to rotate with respect to lower end 16 of the fixed support bar 12. The elbow end 38 of the adjustable lever arm 30 is rigidly connected to the opposite end of the connecting link 42 such that only the end of the connecting link 42 at the pivot connection 44 will rotate freely.

At the wrist end 40 of the adjustable shaft 32 is a hand grip 46 pivotally connected to the wrist end 40 by means of another pivot connection 48. The hand grip 46 is designed to be grasped by the user's hand during bicep exercises.

One or more springs 50 are mounted to the elongated fixed support bar 12. At the lower end of the springs 50 is a quick disconnect hook mechanism 52 which has a flexible connector strap or cable 54 wrapped around hook 52. The opposite end of the strap 54 is connected to the connecting link 42 at the elbow end 38. The strap 54 passes over a roller 56 mounted on a shaft 58 which in turn is mounted on the lower end 16 of the support bar 12.

To do bicep exercises, the user first places the shoulder harness 20 over the shoulder of the arm to be exercised. The adjustable lever arm 30 is in substantially parallel vertical alignment with the elongated fixed support bar 12. The user grasps the hand grip 46 with the hand of the arm which is going to be exercised. His opposite hand grasps the handle 26 to provide stability during exercising. The user then raises his forearm and pivots at the elbow performing the exercise commonly called "curls." After the desired number of repetitions is performed the user repeats the same exercises except with the other arm. If the user has built up sufficient strength, the springs 50 with which he has been working can be removed and substituted with stronger springs. Ideally, the device is provided with spring packs having a plurality of springs with varying forces within the spring pack. By removing one spring pack and placing a new spring pack in its place, the user can easily adjust the spring force against which the user must rotate the adjustable lever arm 30 around the pivot connection 44. It can be seen that the user pivots the lever arm 30 about pivot connection 44 extending the springs 50 as the adjustable lever arm 30 is rotated. The higher the spring tension, the more strength is needed to pull the strap 54 around the roller 56 and rotate the lever arm 30.

Figure 2:
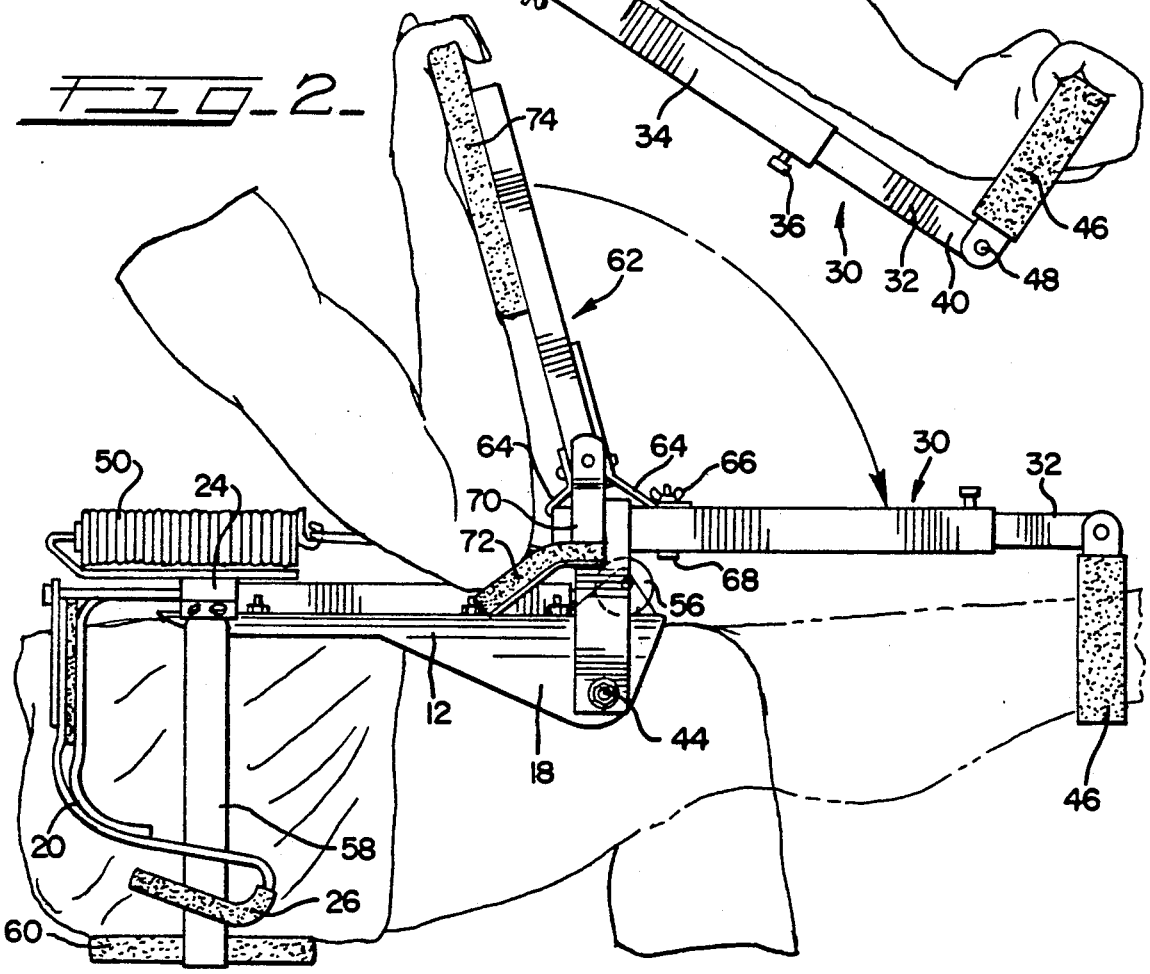
FIG. 2 is a side view of the exercise device having the triceps attachment bar mounted thereon with the exercise device strapped to the user's leg with the user assuming a sitting position.

In FIG. 2 there is illustrated two additional exercises which can be performed with the inventive device. The first exercise which can be performed without modifying the exercise device 10 is leg curls. The device is strapped to the user's leg by a leg strap 58 which has a seat pad 60. The strap 58 is placed around the top portion of the user's leg and attaches to the upper end 14 of the fixed support bar 12. The leg strap 58 is tightened such that the fixed support bar 12 rests firmly and snugly against the top of the leg between the hip and knee. The shoulder harness 20 is either pivoted out of the way of the user's leg by pivoting it around the pivotal connection 24 or removed from the support bar 12. The concave cup like member 18 receives the leg to provide stability during exercising. The user places the lower portion of his leg just above the ankle through the hand grip 46. The hand grip 46 is designed with an opening (not illustrated) along one side such that the leg can be slid sideways into the hand grip 46 without requiring the foot to be slid through it. The adjustable lever arm 30 has the adjustable shaft 32 extended outward to provide a comfortable placement for the user's leg during the leg curls. The exercise is then performed in a similar manner to which the bicep curls are performed except in this case the leg muscles or bicep femoris are exercised.

By means of a tricep attachment bar 62 the user can also perform tricep muscle exercises. The attachment to bar 62 has a connection brace 64 at its lower end which securely attaches to the elbow end 38 of the adjustable lever arm 30. The connection brace 64 is connected by wing nut 66 and bolt 68 which passes through the adjustable lever arm 30. There is also provided a support member 70 having an elbow rest 72 at the lower end of the tricep attachment bar 62. Thus, the user can rest his elbow on the elbow rest during the tricep exercise. A push pad 74 or hand grip may be provided at the top of the tricep attachment bar 62 to provide a comfortable surface against which the user presses his forearm or hand. With the tricep attachment bar 62, the user places his forearm or hand against push pad or grip 74 and pushes against the attachment bar 62 to rotate the adjustable lever arm 30 downward as seen in FIG. 2. The mechanical operation of the portable exercise device 10 remains the same with the spring 50 exerting a force against the direction of movement of the adjustable lever arm 30.

Figure 3:
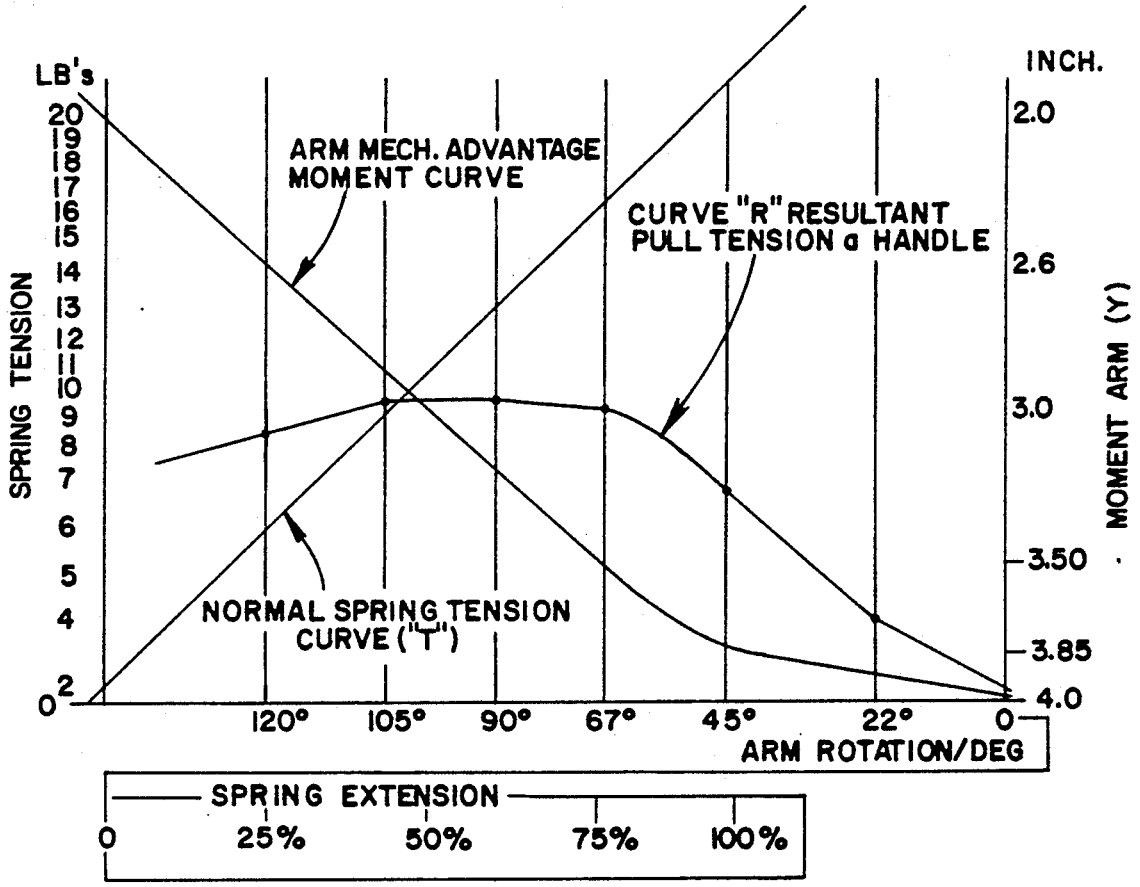
FIG. 3 is a graph showing the spring tension, arm mechanical advantage moment curve and the resultant force curve at the handle.

It is well known that the spring tension or resistive force is directly proportional to the extension of the spring. Accordingly, as the spring continues to be stretched during the exercise its tension or force exerted against the adjustable lever arm continues to increase. (See FIG. 3) However, it is desirable during the exercises to provide a more constant force against which the user is exercising. Accordingly, in the preferred configuration, the connecting link 42 provides a moment arm of varying length which provides a varying mechanical advantage. This is illustrated in FIG. 3. The normal spring tension curve T which is linear, begins at 0% spring extension at which time the spring tension is slightly above zero pounds. At approximately 50% extension the spring tension is increased to about 10 pounds and at 75% extension it becomes approximately 16 pounds.

Figure 4:
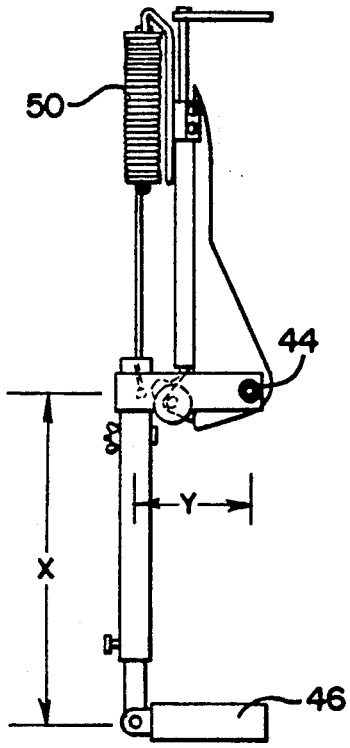
FIG. 4 is a side view of the exercise device in its fully extended normal position.

As seen in FIG. 4 the moment arm about the pivot connection 44 is indicated as the dimension Y. At zero degrees arm rotation the device 10 is in the position illustrated in FIG. 4. The moment arm Y is approximately 4 inches in the preferred embodiment. As the device 10 is operated, and the arm of the user begins pulling up on the hand grip 46, the adjustable lever 30 rotates about the pivot point 44.

Figure 5:
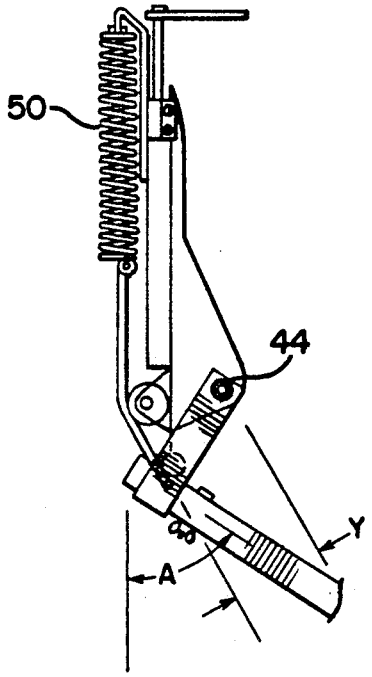
FIG. 5 is a side view of the device in FIG. 4 except the exercise device being illustrated in a partially operated condition and illustrating the gradual reduction in the length in the moment arm.

As seen in FIG. 5 with adjustable lever arm 30 rotated approximately 45°, as illustrated by angle A, the moment arm Y has been decreased to approximately 3.25 inches. This causes the resultant tension at the handle to be reduced as illustrated by the curve R in FIG. 3, resulting in a more constant force at the adjustable arm 30 than if the moment arm did not vary in length. In this manner the increasing tension of the spring (during rotation) pulling against the handle is counteracted by increased arm leverage, thus arm pull force remains fairly constant during the exercise routine.

Figure 6:
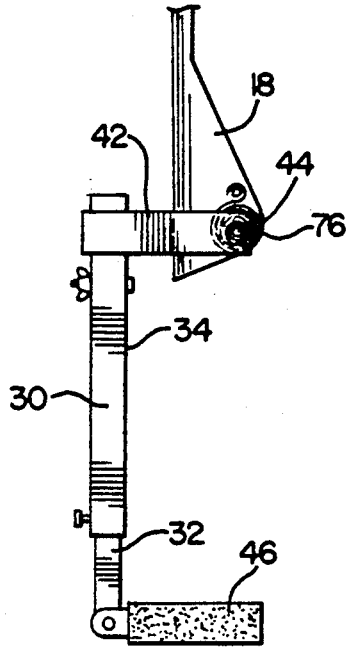
FIG. 6 is a side view of an alternate embodiment of the exercise device utilizing a different spring to produce a force against the muscle being exercised.

Other embodiments of the exercise device are illustrated in FIGS. 6 through 9. The devices illustrated in FIGS. 6, 7 and 8 operate substantially identical to the device illustrated in FIG. 1. In FIG. 6 the spring is a clock spring or torsion spring 77 which is wrapped around the pivot point 44. This spring provides the counter force against which the user will pull the handle grip 46 in an attempt to rotate the adjustable lever arm 30 with respect to the pivot point 44.

Figure 7:
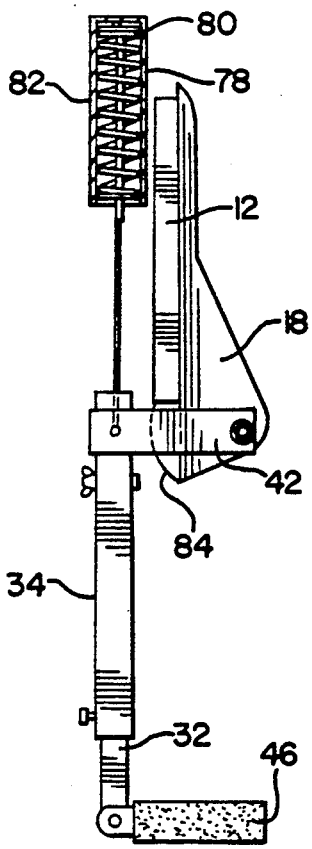
FIG. 7 is a side view of another alternative embodiment having a differing spring mechanism to provide the resistive force.

In FIG. 7 the spring 50 has been changed to a hydraulic cylinder 78 having a piston 80 and return spring 82 within the cylinder 78. The flexible connector 54 will ride around a bearing surface 84 at the lower end 16 of the fixed support bar 12. This bearing surface 84 replaces the roller 56 in the preferred embodiment.

Figure 8:
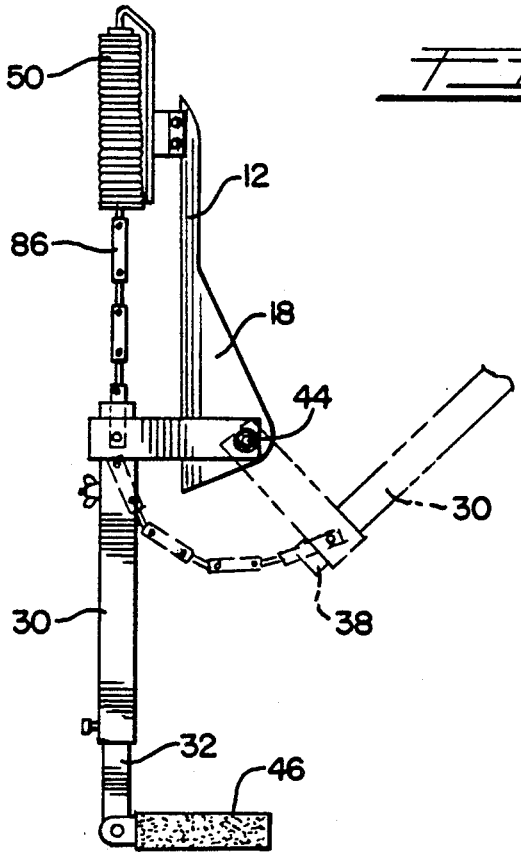
FIG. 8 is yet another alternative embodiment in which a locking linkage connects the spring to the adjustable lever arm to provide an alternate resistive force against the muscle being exercised.

In FIG. 8 the cable or flexible connector 54 has been replaced by a locking linkage 86 which connects the lower end of the spring 50 to the elbow end 38 of the adjustable lever arm 30. The design of the links in the locking linkage 86 only permits one link to pivot a slight amount with respect to an adjacent link. This causes the linkage 86 to assume the configuration illustrated in FIG. 8. Accordingly, the locking linkage 86 does not require the bearing surface 84 or roller 56 to be guided during exercising due to the limited flexibility of the linkage.

Figure 9:
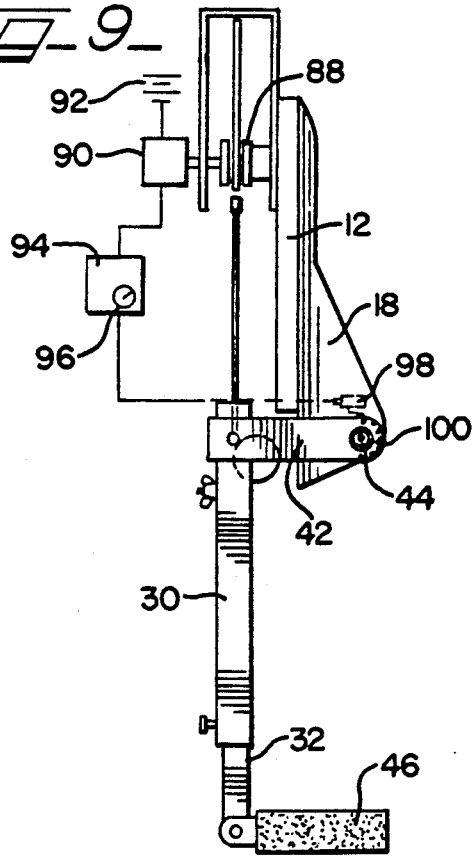
FIG. 9 is yet another alternative embodiment in which an electric solenoid with friction pads provides the resistive force against which the user's muscle must overcome during the exercise cycle.

FIG. 9 illustrates a different concept in providing a force against which the user must rotate the adjustable lever arm 30. In the configuration illustrated in FIG. 9 a pair of friction pads 88 engage the flexible connector 54. By controlling the amount of friction between pads 88 and the connector 54 one can vary the force required to rotate adjustable lever arm 30. The force of the friction pads 88 against the connector 54 is controlled by means of an electric solenoid 90 connected to a power source 92. By means of a timer circuit 94 which can be adjusted by means of an adjustment knob 96 the pulsing of the electric solenoid 90 against the friction pads 88 can be adjusted By means of a micro switch 98 and switch cam 100 a variable force can be applied to the solenoid 90 which will be dependent upon the position of the adjustable lever arm 30. The micro sequence switch 98 and switch cam 100 are connected to the timer circuit 94 to provide input as to the position of the adjustable lever arm 30. In this manner the logic circuitry can be designed to pulsate the friction force across the full range of pivotal movement of the adjustable lever arm 30.

Thus, it is apparent that there has been provided, in accordance with the invention a portable exercise device that fully satisfies the objects, aims and advantages set forth above. While the invention has been described in conjunction with specific embodiments thereof, it is evidence that many alternatives, modifications and variations will be apparent to those skilled in the art in light of the foregoing description. Accordingly, it is intended to embrace all such alternatives, modifications, and variation as fall within the spirit and broad scope of the appended claims.

What is claimed is:

1. A portable exercise device for exercising and strengthening a user's biceps comprising:

a fixed elongated support bar adapted for placement against the user's triceps at the back of the user's arm, the elongated support bar having top and bottom ends;

a shoulder harness connected to the top end of the elongated support bar, the shoulder harness extending over the user's shoulder and terminating at a distal end;

a stabilizing handle on the distal end of the shoulder harness for grasping by the user's hand on the arm not being exercised;

an adjustable lever arm having an elbow end and a wrist end, the elbow end operatively connected by pivot means to the bottom end of the elongated support bar for allowing the elbow end to rotate with respect to the bottom end of the elongated support bar, the adjustable lever arm adapted to be placed against the user's forearm;

a hand grip connected to the wrist end of the adjustable lever arm for grasping by the hand on the arm being exercised;

spring means operatively connected to the fixed elongated support bar, and the adjustable lever arm to provide a force for pulling the adjustable lever arm into substantial parallel alignment with the fixed elongated support bar, whereby the user places the elongated support bar against the triceps on the arm to be exercised, grasps the hand grip with the hand on the same arm, grasps the stabilizing handle with his other hand, and exercises his biceps by pulling on the hand grip to pivot the adjustable lever arm when the spring force is overcome.

2. The device of claim 1 wherein the spring means is connected to the adjustable lever arm by means of a flexible connector having one end connected to the spring means and the other end connected to the adjustable lever arm.

3. The device of claim 2 and further comprising a roller surface mounted on the elongated support bar adjacent the bottom end and disposed between the spring means and the adjustable lever arm with the flexible connector passing over the roller surface as the adjustable lever arm is pivoted.

4. The device of claim 1 wherein the shoulder harness is pivotally connected to the top end of the elongated support bar, the pivotal connection permitting the shoulder harness to be rotated about an axis parallel to the elongated support bar.

5. The device of claim 4 and further comprising a leg strap passing around the user's leg and the fixed support bar for strapping the fixed support bar to the user's leg between the hip and knee, the shoulder harness pivoted out of the way of the user's leg, and the hand grip receiving a lower part of the users leg above the foot, whereby the user can exercise the leg muscles by pulling on the hand grip with his leg to pivot the adjustable lever arm.

6. The device of claim 4 and further comprising a tricep exercising attachment comprising a rigid bar with bracing and mounting means on one end for rigidly attaching the rigid bar to the adjustable lever arm, an elbow rest pad for supporting the user's elbow during exercising, a leg strap passing around the user's leg and the fixed support bar for strapping the fixed support bar to the user's leg between the hip and knee, the shoulder harness pivoted out of the way of the user's leg, the rigid bar protruding upward from the adjustable lever arm when the user assumes a seated position, the rigid bar receiving the forearm of the arm to be exercised, whereby the user exerts a force against the rigid bar overcoming the spring force and causing the adjustable lever arm to rotate.

7. The device of claim 1 and further comprising a connecting link for connecting the bottom end of the elongated support bar to the adjustable lever arm, the pivot means providing the connection between the bottom end of the elongated support bar and the adjustable lever arm, the connecting link creating a variable moment arm resulting in a constant spring force across a greater degree of pivotal movement of the adjustable lever arm than if the adjustable lever arm is directly connected to the elongated support bar.

8. The device of claim 7 wherein the pivot means is offset from the fixed elongated support bar and adjustable lever arm when the two are in alignment, with the connecting link defining the length of the moment arm.

9. The device of claim 1 wherein the spring means comprises a removable spring package having one or more springs therein, the force for pulling the adjustable lever arm being variable depending upon the springs in the spring package.

10. The device of claim 1 wherein the adjustable lever arm comprises an adjustable shaft telescopically received in a tubular housing, the adjustable shaft extensible therefrom, and locking means to lock the adjustable shaft with respect to the tubular housing.

11. A portable exercise device suitable for exercising a users biceps, triceps and leg muscles, the device comprising:

a fixed elongated support bar having a concave portion adapted to receive the users arm during biceps exercises and the user's leg during triceps and leg muscle exercises, the elongated support bar having top and bottom ends, a shoulder harness pivotally connected to the top end of the elongated support bar, the shoulder harness extending over the user's shoulder when the device is used to exercise the biceps and pivoting to a second position when the device is used to exercise the triceps or leg muscles, the shoulder harness terminating at a distal end, a stabilizing handle on the distal end of the should harness for grasping by the user's hand on the arm not being exercised when the user is exercising the biceps, an adjustable lever arm having an elbow end and a wrist end, the elbow end pivotally connected to the bottom end of the elongated support bar for allowing the adjustable lever arm to rotate with respect to the bottom end of the elongated support bar, a hand grip connected to the wrist end of the adjustable lever arm for grasping by the hand on the arm being exercised during biceps exercises, the hand grip further adapted to receive the lower potion of the users leg above the foot during leg muscle exercise, spring means connected to the fixed elongated support bar and the adjustable lever arm to provide a force for pulling the adjustable lever arm into substantial alignment with the fixed elongated support bar, a leg strap passing around the users leg and the fixed support bar for strapping the bar to the user's leg between the hip and knee when doing triceps and leg muscle exercises, means on the adjustable lever arm to receive a rigid bar in a locked relationship, the rigid bar protruding upward from the adjustable lever arm when the user assumes a seated position with the fixed support bar strapped to the user's leg, the rigid bar receiving the forearm of the arm to be exercised during triceps exercises, whereby in biceps exercises the user places the concave portion on the fixed elongated support bar against the triceps on the arm to be exercised, grasps the hand grip with the hand on the same arm, grasps the stabilizing arm with his other hand, and exercises his biceps by pulling on the hand grip against the spring force and pivoting the adjustable lever arm during leg muscle exercises, the user places the concave portion on his leg and straps the fixed support bar thereto, inserts the lower portion of his leg through the hand grip, and exercises the leg muscles by pulling downward on the hand grip to pivot the adjustable lever arm, and in triceps exercises attaches the rigid bar to the adjustable lever arm, and pushes against the rigid bar to rotate the adjustable lever arm.

12. The device of claim 11 wherein the spring means is connected to the adjustable lever arm by means of a flexible connector having one end connected to the spring means and the other end connected to the adjustable lever arm.

13. The device of claim 12 and further comprising a roller surface mounted on the elongated support bar adjacent the bottom end and disposed between the spring means and the adjustable lever arm with the flexible connector passing over the roller surface as the adjustable lever arm is pivoted.

14. The device of claim 11 and further comprising a connecting link for connecting the bottom end of the elongated support bar to the adjustable lever arm, the pivot means providing the connection between the bottom end of the elongated support bar and the adjustable lever arm, the connecting link creating a variable moment arm resulting in a constant spring force across a greater degree of pivotal movement of the adjustable lever arm than if the adjustable lever arm is directly connected to the elongated support bar.

15. The device of claim 14 wherein the pivot means is offset from the fixed elongated support bar and adjustable lever arm when the two are in alignment, with the connecting link defining the length of the moment arm.

16. The device of claim 11 wherein the spring means comprises a removable spring package having one or more springs therein, the force for pulling the adjustable lever arm being variable depending upon the springs in the spring package.

17. The device of claim 11 and further comprising an elbow pad affixed to the rigid bar, the elbow pad providing a resting and supporting surface for the elbow during triceps exercises.

18. The device of claim 11 wherein the adjustable lever arm comprises an adjustable shaft telescopically received in a tubular housing, the adjustable shaft extensible therefrom, and locking means to lock the adjustable shaft with respect to the tubular housing.

* * * * *